US007562630B2

(12) United States Patent
Lee et al.

(10) Patent No.: US 7,562,630 B2
(45) Date of Patent: Jul. 21, 2009

(54) SHELF FOR REFRIGERATOR AND REFRIGERATOR HAVING THE SAME

(75) Inventors: Chang Woo Lee, Changwon (KR); Yong Chol Kwon, Changwon (KR)

(73) Assignee: LG Electronics Inc., Seoul (KR)

( * ) Notice: Subject to any disclaimer, the term of this patent is extended or adjusted under 35 U.S.C. 154(b) by 377 days.

(21) Appl. No.: 11/431,527

(22) Filed: May 11, 2006

(65) Prior Publication Data

US 2006/0254481 A1 Nov. 16, 2006

(30) Foreign Application Priority Data

May 13, 2005 (KR) ..... 10-2005-0040317
Sep. 2, 2005 (KR) ..... 10-2005-0081710

(51) Int. Cl.
*A47B 96/04* (2006.01)

(52) U.S. Cl. ..... 108/108; 312/408

(58) Field of Classification Search ..... 312/404, 312/408, 351; 108/106–108; 211/153, 134, 211/135; 248/235
See application file for complete search history.

(56) References Cited

U.S. PATENT DOCUMENTS 4,355,585 A * 10/1982 Bottamiller et al. .... 108/157.13
4,627,201 A * 12/1986 Hamamoto et al. ..... 52/208
4,733,843 A * 3/1988 Bessinger ..... 248/250
4,736,918 A * 4/1988 Bessinger ..... 248/250
4,871,136 A * 10/1989 Bessinger et al. ..... 248/250
4,917,528 A * 4/1990 Shewchuk ..... 403/231
4,934,541 A * 6/1990 Bussan et al. ..... 211/153
4,936,641 A * 6/1990 Bussan et al. ..... 312/408
5,064,158 A * 11/1991 Brazier et al. ..... 248/250
5,441,338 A * 8/1995 Kane et al. ..... 312/408
5,524,981 A * 6/1996 Herrmann et al. ..... 312/408
6,679,573 B2 * 1/2004 Bienick ..... 312/408
7,237,855 B2 * 7/2007 Vardon ..... 312/408
7,306,304 B2 * 12/2007 Jang ..... 312/408
2002/0149304 A1 * 10/2002 Bienick ..... 312/408
2006/0145577 A1 * 7/2006 Daley et al. ..... 312/408
2006/0162373 A1 * 7/2006 McMillin et al. ..... 62/440

* cited by examiner

*Primary Examiner*—Janet M Wilkens
(74) *Attorney, Agent, or Firm*—Ked & Associates LLP

(57) ABSTRACT

A shelf for a refrigerator and a refrigerator having the same are provided. The shelf includes a support plate having an upper surface, a frame formed to correspond to a shape of a periphery of the support plate and having, at an inner side thereof, a coupling portion to which the support plate is coupled to the coupling portion by a bonding member, and a fixing device that fixes the support plate to the coupling portion. The fixing device may include a fixing member having a supporting protrusion that penetrates though a sidewall of the frame to support the support plate from below. Alternatively, the fixing device may include an elastically deformable resilient hook and a fixing protrusion formed to face the resilient hook, all of which are provided on the frame. With the shelf for a refrigerator constructed as above, there are advantages in that the shelf has a secure coupling structure, the process of coupling the components of the shelf is simplified, the shelf has improved durability, and production costs are reduced.

11 Claims, 6 Drawing Sheets

SHELF FOR REFRIGERATOR AND REFRIGERATOR HAVING THE SAME

BACKGROUND OF THE INVENTION

1. Field of Invention

The present invention relates to a refrigerator, and more particularly, to a shelf for a refrigerator, which allows various kinds of foods to be accommodated in a classified state within a refrigerating chamber of the refrigerator, and a refrigerator having the shelf.

2. Description of the Prior Art

Generally, a plurality of shelves are installed one above another in a refrigerating chamber of a refrigerator so that various kinds of foods can be put thereon, respectively. The shelves for a refrigerator are generally made of transparent synthetic resin. Alternatively, such a shelf is manufactured by placing a glass support plate in a mold and performing insert molding so that the support plate can be integrated with a frame.

FIG. 1 shows a side sectional view of a conventional shelf for a refrigerator.

Referring to the figure, the shelf comprises a frame 4 for defining the body of the shelf, and a support plate 6 installed inside the frame 4 to support an article thereon. The frame 4 is made of synthetic resin. An inner surface of the frame 4 is provided with a seating surface 8 on which the support plate 6 can be seated.

A projection 9 is formed at a side on the seating surface 8. The projection 9 supports the support plate 6 so that the support plate cannot move in a lateral direction. A supporting portion 10 is coupled from below the frame 4 so that the support plate 6 seated on the seating surface 8 cannot come off downward.

A contact surface of the frame 4 to be brought into surface contact with an upper surface of the support plate 6 is recessed so that a sealing member 12 can be seated therein. The sealing member 12 prevents moisture and the like flowing along the upper surface of the support plate 6 from being introduced into a space between the frame 4 and the supporting portion 10.

However, the conventional shelf for a refrigerator described above has the following problem.

The support plate 6 is fixed to the frame 4 by means of bonding in the prior art. However, if the protrusion 9 of the frame 4 does not come into contact with a side surface of the support plate 6 due to tolerance, there is a risk of play of the support plate 6 before a bonding member on the support plate 6 attached to the seating surface 8 is cured.

Further, if an article is put and thus exerts a load on the upper surface of the support plate 6, the weak coupling between the frame 4 and the supporting portion 10 causes the frame 4 and the supporting portion 10 to be easily separated from each other, resulting in lowered durability.

Moreover, the supporting portion 10 for supporting the support plate 6 to the frame 4 is mounted to the frame 4 by means of thermal bonding. To perform the thermal bonding, there is a need for thermal bonding equipment. Thus, facility investment costs are increased. In addition, processing costs involving processes of heating and melting a low melting fiber are increased. Accordingly, there is a problem of increased production costs in the prior art.

SUMMARY OF THE INVENTION

The present invention is conceived to solve the aforementioned problems in the prior art. An object of the present invention is to provide a shelf for a refrigerator, wherein a support plate of the shelf does not move relative to a frame of the shelf before a bonding member is completely cured.

Another object of the present invention is to provide a shelf for a refrigerator, wherein a support plate of the shelf is not easily separated from a frame of the shelf even through an article is put and exerts a load on the support plate.

A further object of the present invention is to provide a shelf structure for a refrigerator, which can be manufactured at low costs.

According to an aspect of the present invention for achieving the objects, there is provided a shelf for a refrigerator, comprising a support plate having an upper surface on which an article is to be put; a frame formed to correspond to the shape of a periphery of the support plate and having, at an inner side thereof, a coupling portion to which the support plate is coupled by means of a bonding member; and a fixing device for fixing the support plate to the coupling portion, wherein the fixing device comprises a fixing member supported by the frame and having a supporting protrusion for supporting the support plate from below.

Here, the frame may have a sidewall formed with a through-hole, and the fixing member may comprise a body brought into close contact with the sidewall of the frame, and a supporting protrusion extending from the body to pass through the through-hole so that the supporting protrusion can be in contact with the support plate.

The supporting protrusion may have an upper surface with a supporting ridge protruding therefrom.

The fixing member may be provided at each of both lateral sides of the frame.

The supporting protrusion may be formed as an elastically deformable resilient member.

According to another aspect of the present invention, there is provided a shelf for a refrigerator, comprising a support plate having an upper surface on which an article is to be put; a frame formed to correspond to the shape of a periphery of the support plate and having, at an inner side thereof, a coupling portion to which the support plate is coupled by means of a bonding member; and a fixing device for fixing the support plate to the coupling portion, wherein the fixing device comprises an elastically deformable resilient hook and a fixing protrusion formed to face the resilient hook, the resilient hook and the fixing protrusion being provided on the frame.

The coupling portion may comprise a catching protrusion brought into contact with the upper surface of the support plate, and a flange protruding perpendicularly to the catching protrusion so as to be in contact with a side surface of the support plate.

The resilient hook may have a slant portion in a bent shape to be elastically deformed, an end of the support plate may be moved while being guided along the slant portion, and a distal end of the slant portion may support the upper surface of the support plate when the support plate is seated on the coupling portion.

A first supporting member for supporting the support plate may be fastened to a portion of the frame close to a corner of the support plate.

The first supporting member may be formed with a first screw hole through which a screw is fastened to fix the first supporting member to the frame.

The first supporting member may be further formed with a first supporting hole through which a screw is fastened to support the support plate.

Meanwhile, a second supporting member for supporting the support plate may be fastened to a portion of each lateral side of the frame.

Here, the second supporting member may be formed with a second screw hole through which a screw is fastened to fix the second supporting member to the frame.

A distal end of the flange may be provided with a fastening boss to which a screw can be fastened and fixed so that the screw can be fastened to the fastening boss and the second screw hole.

Moreover, the second supporting member may be formed with a second supporting hole to which a screw can be fastened to support the support plate.

With the shelf for a refrigerator according to the present invention constructed as above, the support plate can be securely coupled to the frame. Therefore, even after the bonding member is cured, the fixing device can support the weight of a food put on the support plate, thereby improving durability of the shelf. Further, upon attachment of the support plate to the bonding member applied to the frame, the support plate is stably fixed until the bonding member is cured, resulting in a lowered percent defective.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF THE PREFERRED EMBODIMENT

Hereinafter, preferred embodiments of a shelf for a refrigerator according to the present invention will be described in detail with reference to the accompanying drawings.

Figure 1:
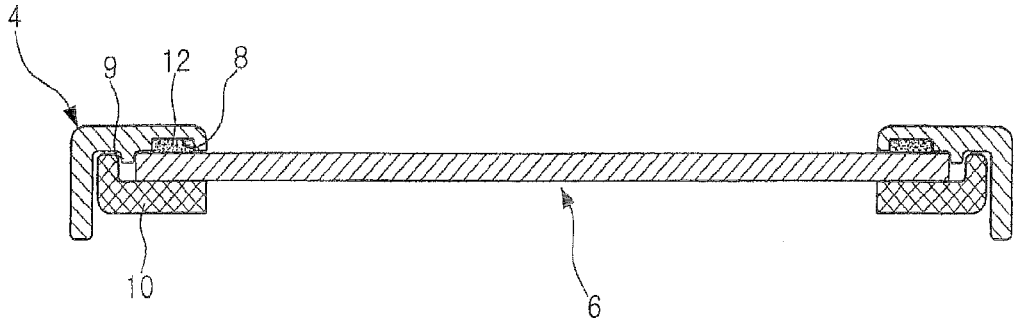
CONVENTIONAL ART FIG. 1
FIG. 1 is a side sectional view of a conventional shelf for a refrigerator.
Figure 2:
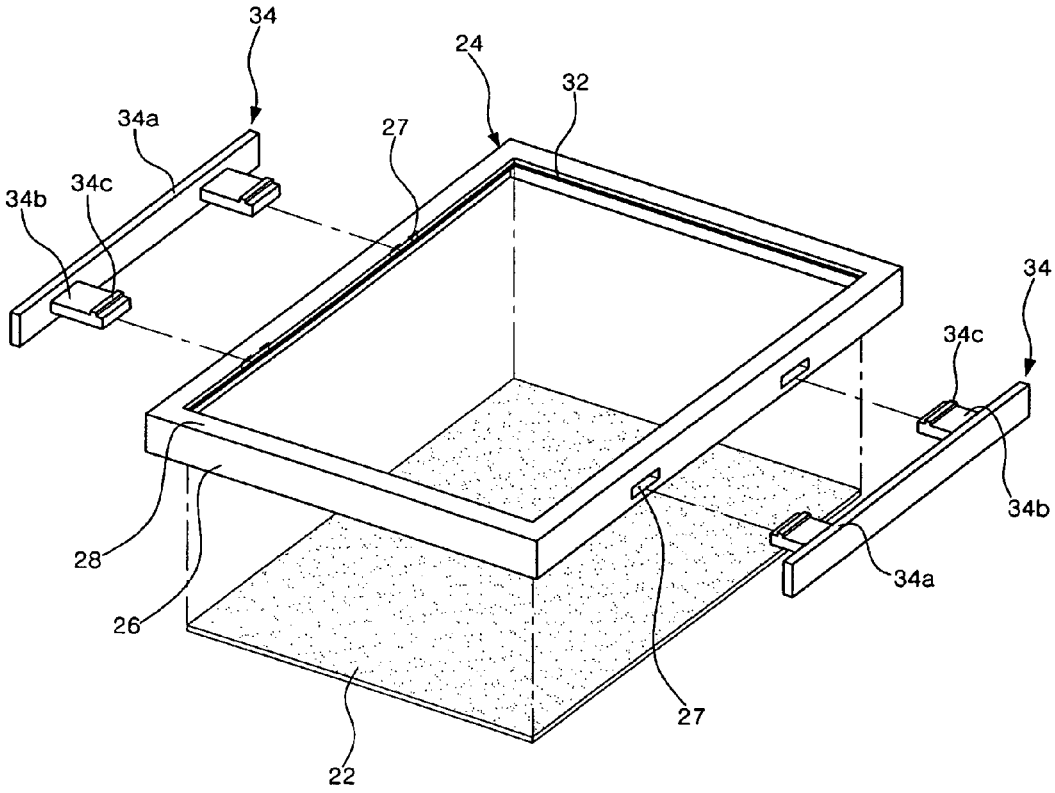
FIG. 2 is an exploded perspective view showing the structure of a shelf for a refrigerator according to a preferred embodiment of the present invention.
Figure 3:
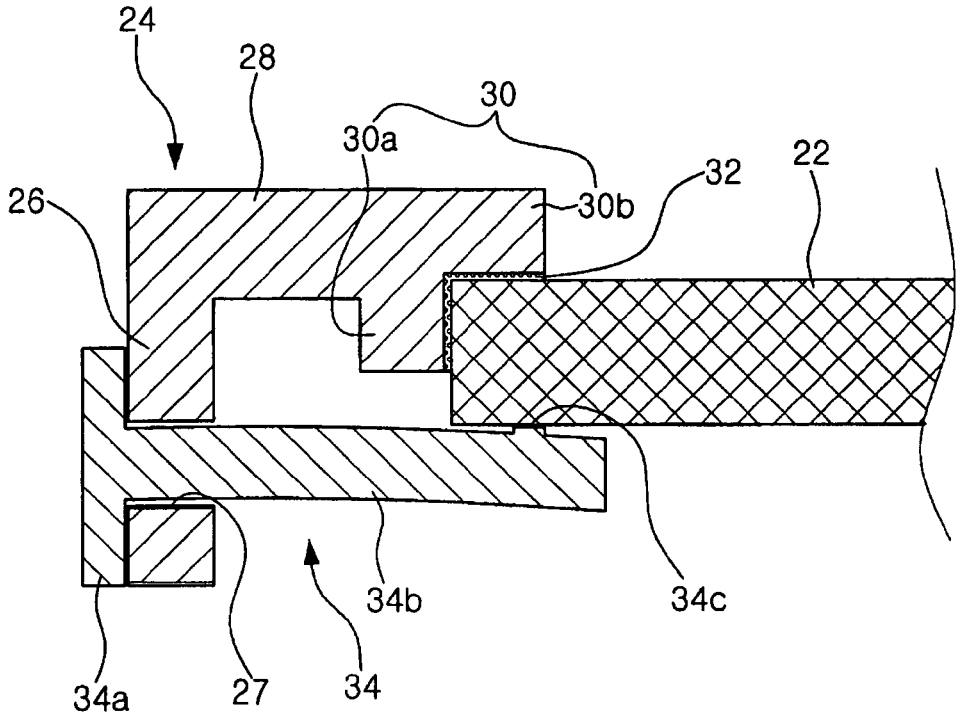
FIG. 3 is a side sectional view showing a major portion of the shelf according to the embodiment of the present invention.
Figure 4:
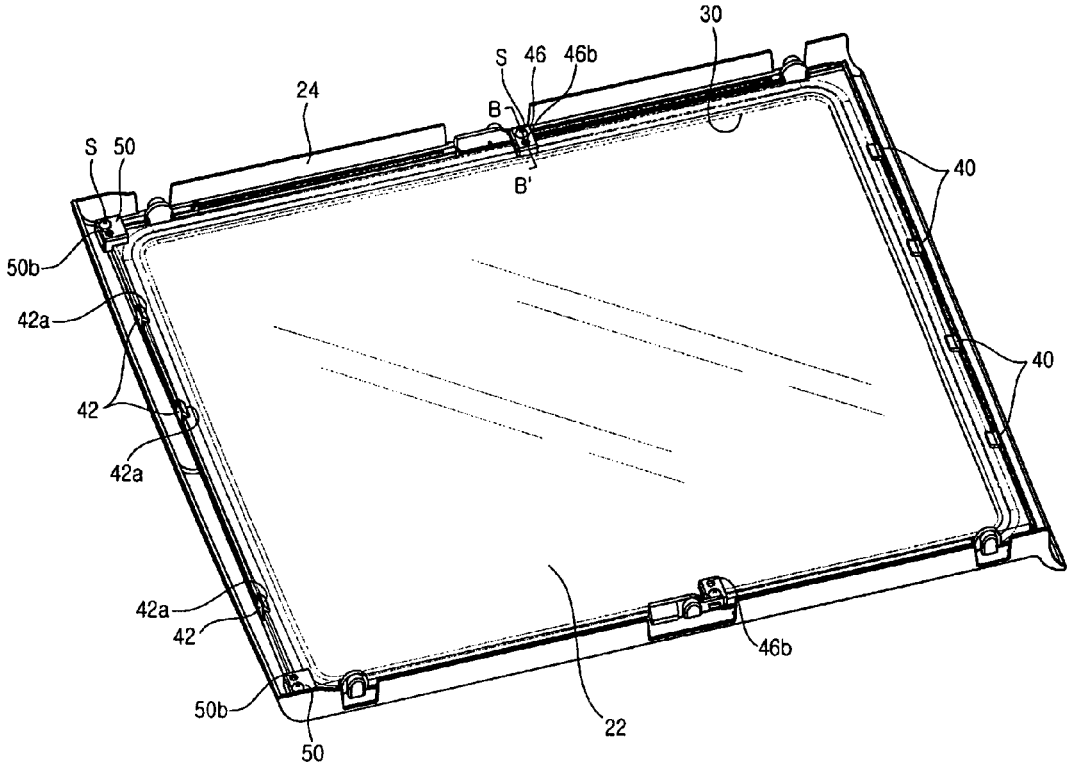
FIG. 4 is a perspective view of a shelf for a refrigerator according to another embodiment of the present invention.
Figure 5:
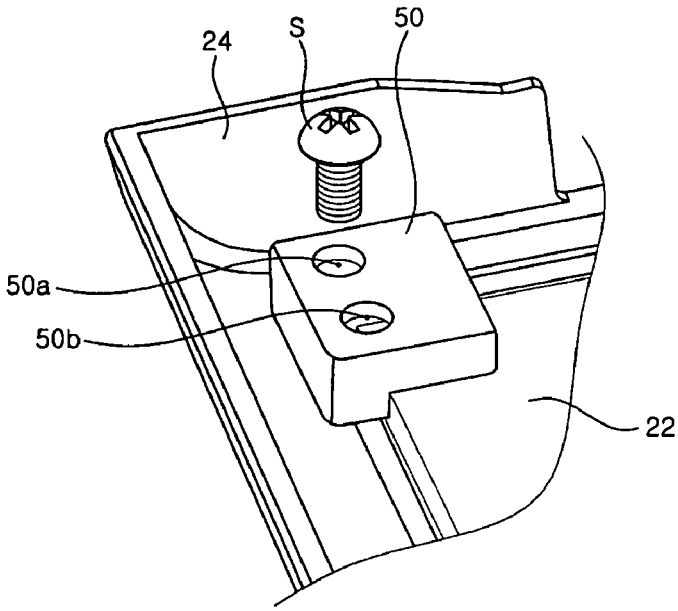
FIG. 5 is a perspective view showing a first supporting member of the shelf according to the other embodiment of the present invention.
Figure 6:
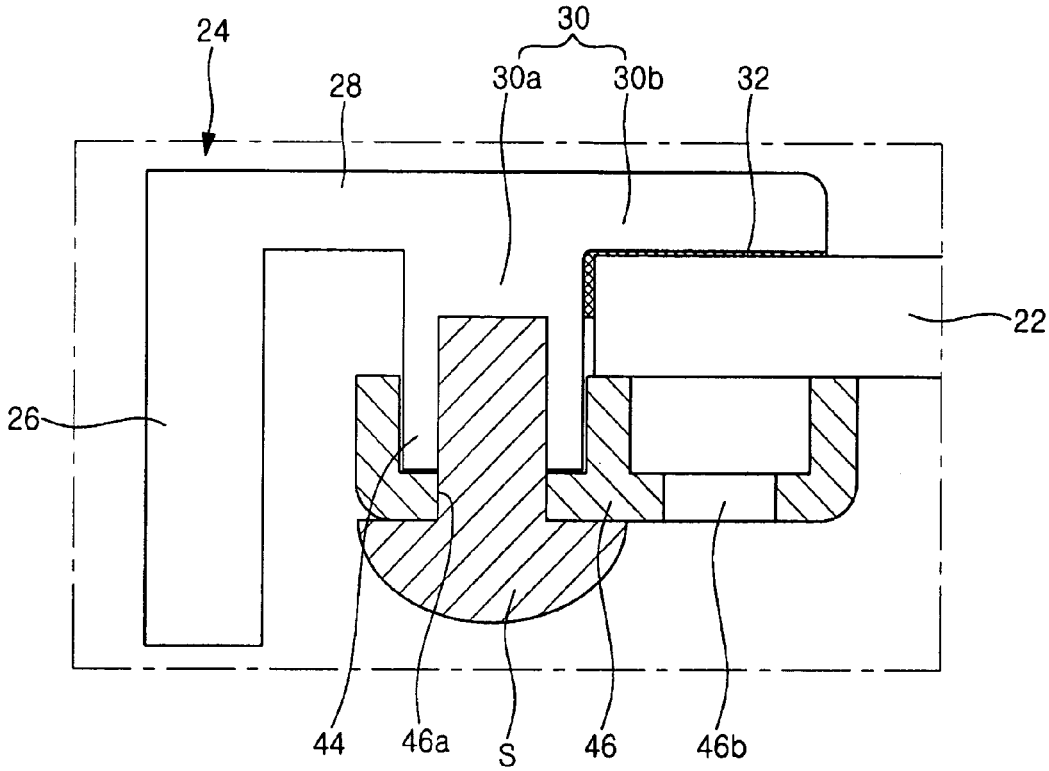
FIG. 6 is a perspective view showing a second supporting member of the shelf according to the other embodiment of the present invention.

FIG. 2 is an exploded perspective view showing the structure of a shelf for a refrigerator according to a preferred embodiment of the present invention, FIG. 3 is a side sectional view showing a major portion of the shelf according to the embodiment of the present invention, FIG. 4 is a perspective view of a shelf for a refrigerator according to another embodiment of the present invention, FIG. 5 is a perspective view showing a first supporting member of the shelf according to the other embodiment of the present invention, and FIG. 6 is a perspective view showing a second supporting member of the shelf according to the other embodiment of the present invention.

Referring to these figures, the shelf comprises a support plate 22 for supporting an article thereon, and a frame 24 for defining the body of the shelf. The support plate 22 supports an article to be accommodated in a refrigerating chamber (not shown) of the refrigerator. Therefore, the support plate 22 is generally made of transparent synthetic resin or reinforced glass so that it cannot be broken due to ordinary impact while supporting the weight of an article put on an upper surface of the support plate 22. The support plate 22 is generally formed to take the shape of a rectangular plate. However, it may be formed in different shapes if necessary.

The frame 24 is made of synthetic resin to define the body of the shape. The frame is formed to conform to the shape of the support plate 22. That is, if the support plate 22 is formed in a rectangular shape, the frame 24 is also formed in a rectangular shape.

A skirt 26 is vertically formed at a periphery of the frame 24 such that the skirt can be seated on and guided by rails (not shown) provided in a refrigerating chamber (not shown). In other words, the skirt is formed perpendicularly to the support plate 22. That is, a lower end of the skirt 26 is seated on the rails so that the shelf can be moved horizontally along upper surfaces of the rails.

A horizontal portion 28 is formed inwardly from and integrally with the skirt 26. The horizontal portion 28 is orthogonal to the skirt 26. A coupling portion 30 to be coupled to the support plate 22 is formed inwardly from the horizontal portion 28. The coupling portion 30 comprises a flange 30*a* extending perpendicularly to the horizontal portion 28, and a catching protrusion 30*b* extending parallel to the horizontal portion 28.

The flange 30*a* fixes the support plate 22 seated thereon, so that the support plate 22 cannot be moved in a fore and aft direction and in a lateral direction. The flange 30*a* should be formed such that a distal end thereof does not extend beyond a lower surface of the support plate 22. This is to ensure that supporting protrusions 34*b* of a supporting member 34, which will be described later, are brought into sufficient contact with the lower surface of the support plate 22. An inner side surface of the catching protrusion 30*b* is in close contact with an edge of the upper surface of the support plate 22 so that the support plate 22 cannot come off upwardly.

To achieve coupling between an edge of the support plate 22 and the coupling portion 30, a bonding member 32 is applied to an inner side surface of the coupling portion 30. The bonding member 32 applied to the inner side surface of the coupling portion 30 completely fixes the edge of the support plate 22 to the inner side surface of the coupling portion 30.

Meanwhile, the frame is provided with a fixing device for fixing the support plate 22 to the coupling portion 30.

As for the fixing device in a preferred embodiment of the present invention, the fixing member 34 is used to fix the support plate 22 to the coupling portion 30 of the frame 24. The fixing member 34 is formed with a body 34*a* to be brought into close contact with the skirt 26. The body 34*a* is provided with the supporting protrusions 34*b* protruding perpendicularly to the body 34*a*.

At this time, the skirt 26 is formed with a plurality of through-holes 27. The through-holes 27 allow the supporting protrusions 34*b* of the supporting member 34 to penetrate therethrough. The through-holes 27 may be formed to correspond to each other in opposite portions of the skirt 26.

The supporting protrusions 34*b* penetrate through the through-holes 27 and support the lower surface of the support plate 22 that has been fixed to the coupling portion 30 by means of the bonding member 32.

When the supporting protrusions 34*b* are engaged with the through-holes 27 of the skirt 26, the supporting protrusions 34*b* exert elastic forces. This is because the supporting protrusions 34*b* have elasticity due to the characteristics of their material and shape. Therefore, the support plate is in close contact with the lower surface of the catching protrusion 30*b*. Further, a contact surface of each of the supporting protrusions 34*b*, which comes into the contact with the support plate 22, may be formed with a supporting ridge 34*c*. The supporting ridge 34*c* is to more stably support the lower surface of the support plate 22. Depending on the through-holes 27 formed in the skirt 26, a plurality of fixing members 34 may be provided.

As for a fixing device in another embodiment of the present invention, the fixing device comprises a plurality of fixing protrusions 40 formed at a predetermined interval at a rear end of the frame 24, and a plurality of resilient hooks 42 formed at a predetermined interval at a front end of the frame 24, as shown in FIG. 4.

The fixing protrusions 40 function to prevent a rear end of the support plate 22 coupled to the frame 24 from being raised upwardly. That is, after the support plate 22 is coupled to the frame 24, the rear end of the support plate 22 is placed between the coupling portion 30 and the fixing protrusions 40. At this time, the fixing protrusions 40 press down the upper surface of the support plate 22 so that the rear end of the support plate 20 can be securely supported by the fixing protrusions 40. Meanwhile, the fixing protrusions 40 are formed integrally with the frame 24 by means of injection molding out of synthetic resin.

In the meantime, each of the resilient hooks 42 has a slant portion 42*a* in a bent shape such that it can be elastically deformed. The slant portion 42*a* ensures smooth coupling of the support plate 22 to the frame 24. That is, the support plate 22 is coupled to the frame 24 by placing the rear end of the support plate between the coupling portion 30 and the fixing protrusions 40 and lowering the front end of the support plate.

Here, the supporting plate 22 is in contact with the slant portions 42*a*. Since the slant portions 42*a* of the resilient hooks can be elastically deformed, the support plate 22 can be seated on the coupling portion 30 without being disturbed by the resilient hooks 42. Meanwhile, the resilient hooks 42 are formed integrally with the frame 24 by means of injection molding out of synthetic resin.

The resilient hooks 42 prevent the front end of the support plate 22 coupled to the frame 24 from being raised upwardly. That is, after the support plate 22 is coupled to the frame 24, the front end of the support plate 22 is positioned between the coupling portion 30 and the resilient hooks 42. At this time, since distal ends of the slant portions 42*a* of the resilient hooks press down the upper surface of the support plate 22, the rear end of the support plate 22 is securely supported by the resilient hooks 42.

Meanwhile, a flange 30*a* of the coupling portion at a corner of the frame 24 is provided with a fastening boss 44, as well shown in FIG. 6. The fastening boss 44 functions to fix supporting members 46 and 50, which will be described below, to the frame 24. That is, screws S are fastened to the fastening boss 44 through screw holes 46*a* and 50*a* formed in the supporting members 46 and 50. Therefore, the supporting members 46 and 50 are fixed to the frame 24. The position and number of the fastening boss 44 can be arbitrarily selected. However, it is preferred that such fastening bosses be uniformly distributed at predetermined intervals at corners and intermediate portions of sides of the frame 24 in consideration of stable distribution of supporting forces.

For the sake of convenience of description, the supporting members 46 and 50 will be described herein by dividing them into the first supporting member 50 and the second supporting member 46. The first and second supporting members 50 and 46 have the same structure but are different from each other only in their positions. That is, to support the support plate 22 by the supporting members 46 and 50, it is preferred in view of mechanics that the supporting members 46 and 50 be installed at the corners of the frame 24. At this time, a supporting member provided at a corner of the frame 24 is referred to as the "first supporting member 50." If an additional supporting member is installed, e.g., a supporting member is provided at a portion of a side of the frame 24, the supporting member is referred to as the "second supporting member 46."

Meanwhile, the support plate 22 is coupled to the frame 24. The support plate 22 is fixed to the frame 24 by being attached to the bonding member 32 provided in the coupling portion 30. Of course, the fixing protrusions 40 and the resilient hooks 42 also securely fix the support plate 22 to the frame 24 as described above. The support plate 22 is made of glass or plastics.

Meanwhile, to more securely fix the support plate 22 coupled to the frame 24, the shelf of the present invention comprises the first supporting members 50. The first supporting member 50 is formed with a first screw hole 50*a*. The first supporting member 50 is coupled to the frame 24 in such a manner that a screw S is fastened through the first screw hole 50*a*. Further, the first supporting member 50 may have a first supporting hole 50*b* at a portion thereof brought into contact with the support plate 22. The first supporting hole 50*b* is used for fixing the support plate 22 to the first supporting member by means of thread engagement of a screw S.

After the first supporting member 50 is coupled to the frame 24, a part of the first supporting member 50 supports the support plate 22 to further prevent play of the support plate 22. Meanwhile, the first supporting members 50 are preferably coupled to comers of the frame 24, which are close to comers of the front end of the support plate 22, so as to support the corners of the support plate 22.

The shelf of the present invention further comprises the second supporting members 46 for more securely fixing the support plate 22 to the frame 24 in the same manner as the first supporting members 50. The second supporting member 46 is formed with a second screw hole 46*a*.

The second supporting member 46 is coupled to the frame 24 in such a manner that a screw S is fastened through the second screw hole 46*a*. The second supporting member 46 is further provided with a second supporting hole 46*b* at a portion thereof brought into contact with the support plate 22. The second supporting hole 46*b* is used for fixing the support plate 22 to the second supporting member by means of thread engagement of a screw S.

After the second supporting member 46 is coupled to the frame 24, a part of the second supporting member 46 supports the support plate 22 to further prevent play of the support plate 22. Meanwhile, the second supporting member 46 is preferably coupled to an intermediate portion of each lateral side of the frame 24, which is close to an intermediate portion of each lateral side of the support plate 22, so as to support the intermediate portion of the lateral side of the support plate 22.

The operation of the shelf for a refrigerator according to the present invention constructed as above will be specifically described in order of assembly.

First, the operation of the shelf according to the preferred embodiment of the present invention will be explained. The frame 24 is turned over such that the flange 30*a* of the frame 24 is directed upward. Then, the bonding member 32 is applied to the inner side surface of the coupling portion 30 of the frame 24. The support plate 22 is seated on the inner side surface of the coupling portion 30 to which the bonding member 32 has been applied. When the support plate 22 is seated on the coupling portion 30, the periphery of the support plate 22 is brought into close contact with the inner side surface of the coupling portion 30. That is, an upper peripheral surface of the support plate 22 is brought into close contact with the lower surface of the catching protrusion 30*b*, while a side peripheral surface of the support plate 22 is brought into close contact with the inner side surface of the flange 30*a*.

After the support plate 22 is seated on the frame 24 through the bonding member 32, the support plate 22 may be detached from the frame 24 before the bonding member 32 is cured and the support plate 22 is completely fixed to the frame 24. To prevent the support plate 22 from being detached from the frame 24, the supporting protrusions 34*b* of the supporting member 34 are passed through the through-holes 27 formed in each lateral side of the skirt 26. At this time, a surface of each of the supporting protrusions 34*b* is in close contact with the lower surface of the supporting plate 22. Particularly, the supporting ridge 34*c* of the supporting protrusion 34*b* is in close contact with the lower surface of the supporting plate 22.

Since the support plate 22 is supported from below by the supporting protrusions 34*b* of the fixing member 34, the supporting protrusions 34*b* partially support the weight of a food put on the support plate 22.

Next, the operation of the shelf according to the other embodiment of the present invention will be explained. The rear end of the support plate 22 is inserted into the space between the coupling portion 30 and the fixing protrusions 40 and the raised front end of the support plate 22 is lowered so that the front end of the support plate 22 can be moved while coming into contact with the slant portions 42*a*.

Here, the resilient hooks 42 are elastically deformed due to the structural features of the slant portions 42*a* and thus do not disturb the downward movement of the support plate 22. Once the front end of the support plate 22 has passed by the slant portions 42*a*, the slant portions 42*a* are restored to their original states so that the distal ends of the slant portions can press down the support plate 22. When the support plate 22 is seated on the coupling portion 30, the support plate 22 is primarily fixed to the frame 24 by means of the bonding member 32 attached to the coupling portion 30.

After the support plate 22 is seated on the coupling portion 30, the first supporting members 50 are coupled to both comers of the front end of the frame 24 by means of thread engagement of the screw S. Then, the second supporting members 46 are coupled to the intermediate portions of the both lateral sides of the frame 24 by means of thread engagement of the screw S. At this time, to more securely fix the support plate 22, the support plate 22 may be supported by threadly engaging the screws S with the first and second supporting holes 50*b* and 46*b* formed respectively in the first and second supporting members 50 and 46.

In the assembled state of the shelf of the present invention, the fixing protrusions 40 support the rear end of the support plate 22. The slant portions 42*a* of the resilient hooks 42 support the front end of the support plate 22. Therefore, the support plate 22 is not arbitrarily moved.

The first and second supporting members 50 and 46 support the front end and intermediate portions of the support plate 22, respectively. Thus, the support plate 22 is more securely fixed to the frame 24.

This embodiment of the present invention can be modified in various manners. For example, although the first supporting members 50 are fastened to the comers of the front end of the frame 24, they may be fastened to comers of the rear end of the frame 24.

In the illustrated embodiment, the resilient hooks 42 and the fixing protrusions 40 are provided at the front and rear ends of the frame 24, respectively. On the contrary, the resilient hooks 42 and the fixing protrusions 40 may be provided at the rear and front ends of the frame 24, respectively.

In the shelf for a refrigerator according to the present invention described in detail above, the following advantages can be expected.

Since the supporting protrusions of the fixing member support the support plate from below in the preferred embodiment of the present invention, they upwardly support the support plate so that the support plate cannot be moved before the bonding member is cured upon attachment of the support plate to the bonding member applied to the frame. Thus, the support plate can be stably fixed, resulting in a lowered percent defective.

Further, since the supporting protrusions of the fixing member continuously support the support plate from below, they partially support the weight of a food put on the shelf even when the bonding member of the shelf is cured. Therefore, the shelf has improved durability.

Meanwhile, in the other embodiment of the present invention, the shelf of the present invention has an advantage in that the resilient hooks and the fixing protrusions provided respectively in the front and rear ends of the frame securely support the support plate coupled to the frame. Furthermore, since the resilient hooks have the elastically deformable slant portions, the front end of the support plate can be smoothly seated on the coupling portion.

Moreover, since the first and second supporting members are fastened to the frame so that they can support the front end and intermediate portions of the support plate, there is an advantage in that the support plate coupled to the frame can be more securely fixed.

Consequently, since the resilient hooks, the fixing protrusions, and the first and second supporting members all of which are means for securely fixing the support plate to the frame can be formed by means of injection molding, the support plate can be securely fixed to the frame, and at the same time, production costs can be reduced. Accordingly, there is an advantage in that consumer's purchase desire is increased.

The scope of the present invention is not limited to the illustrated embodiments but defined by the appended claims. It will be apparent to those skilled in the art that various modifications and changes can be made thereto within the spirit and scope of the present invention defined by the claims.

What is claimed is:

1. A shelf for a refrigerator, comprising:

a support plate having an upper surface configured to receive an article thereon;

a frame formed to correspond to a shape of a periphery of the support plate and having a coupling portion at an inner side thereof, the support plate being coupled to the coupling portion by a boning member; and a fixing device that fixes the support plate to the coupling portion, wherein the fixing device comprises a fixing member supported by the frame and having a supporting protrusion that supports the support plate from below, and wherein the frame has a sidewall formed with a through-hole, and the fixing member comprises a body brought into close contact with the sidewall of the frame, and the supporting protrusion extends from the body to pass through the through-hole so that the supporting protrusion is in contact with the support plate.

2. The shelf as claimed in claim 1, wherein the supporting protrusion has an upper surface with a supporting ridge protruding therefrom.

3. The shelf as claimed in claim 1, wherein the fixing member is provided at both lateral sides of the frame.

4. The shelf as claimed in claim 1, wherein the supporting protrusion is formed as an elastically deformable resilient member.

5. A shelf for a refrigerator, comprising:

a support plate having an upper surface configured to receive an article thereon;

a frame formed to correspond to a shape of a periphery of the support plate and having a coupling portion at an inner side thereof, the support plate being coupled to the coupling portion by a bonding member; and a fixing device that fixes the support plate to the coupling portion, wherein the fixing device comprises an elastically deformable resilient hook and a fixing protrusion formed to face the resilient hook, the resilient hook and the fixing protrusion being provided on the frame, wherein a supporting member that supports the support plate is fastened to a portion of the frame close to the support plate, and wherein the supporting member is formed with a supporting hole through which a screw is fastened to support the support plate.

6. The shelf as claimed in claim 5, wherein the coupling portion comprises a catching protrusion brought into contact with the upper surface of the support plate, and a flange that protrudes perpendicularly to the catching protrusion so as to be in contact with a side surface of the support plate.

7. The shelf as claimed in claim 5, wherein the resilient hook has a slant portion in a bent shape to be elastically deformed, an end of the support plate is moved while being guided along the slant portion, and a distal end of the slant portion supports the upper surface of the support plate when the support plate is seated on the coupling portion.

8. The shelf as claimed in claim 5, wherein the supporting member is formed with a screw hole through which a screw is fastened to fix the supporting member to the frame.

9. The shelf as claimed in claim 8, wherein a side of the frame brought into contact with the supporting member is provided with a fastening boss to which a screw is fastened and fixed.

10. A refrigerator, comprising:

a shelf including:

a support plate having an upper surface configured to receive an article thereon;

a frame formed to correspond to a shape of a periphery of the support plate and having a coupling portion at an inner side thereof, the support plate being coupled to the coupling portion by a bonding member; and a fixing device that fixes the support plate to the coupling portion, wherein the fixing device comprises a fixing member supported by the frame and having a supporting protrusion for supporting the support plate from be1ow; and wherein the frame has a sidewall formed with a through-hole, and the fixing member comprises a body brought into close contact with the sidewall of the frame, and the supporting protrusion extends from the body to pass through the through-hole so that the supporting protrusion is in contact with the support plate.

11. A refrigerator, comprising:

a shelf including:

a support plate having an upper surface configured to receive an article is thereon;

a frame formed to correspond to a shape of a periphery of the support plate and having a coupling portion at an inner side thereof, the support plate being coupled to the coupling portion by a bonding member;

a fixing device that fixes the support plate to the coupling portion; and a supporting member fastened to a portion of the frame close to the support plate so as to support the support plate, wherein the supporting member is formed with a supporting hole through which a screw is fastened to support the support plate, and wherein the fixing device comprises an elastically deformable resilient hook and a fixing protrusion formed to face the resilient hook, the resilient hook and the fixing protrusion being provided on the frame.

* * * * *